US005748692A

United States Patent [19]

Burton

[11] Patent Number: 5,748,692

[45] Date of Patent: May 5, 1998

[54] RACK LOADER AND METHOD FOR TRANSURANIC TRANSFERS INTO AND OUT OF STORAGE

[75] Inventor: Harold M. Burton, New Market, Md.

[73] Assignee: Scientech Inc., Rockville, Md.

[21] Appl. No.: 565,338

[22] Filed: Nov. 30, 1995

[51] Int. Cl.[6] ..... G21C 19/32; G21F 7/00

[52] U.S. Cl. ..... 376/272; 376/250

[58] Field of Search ..... 376/260, 261, 376/269, 272, 287, 250; 250/506.1, 507.1

[56] References Cited

U.S. PATENT DOCUMENTS 4,866,286 9/1989 Baatz et al. ..... 376/272
5,319,686 6/1994 Pizzano et al. ..... 376/272

*Primary Examiner*—Daniel D. Wasil
*Attorney, Agent, or Firm*—Fenwick & West LLP

[57] ABSTRACT

A shielded rack loader makes use of a loading rack movable between a shielding structure and a storage tube. A shield plug seals the storage tube. A hoist moves the shield plug and the loading rack. A shield plug cart and a material transfer cart mate with receiving flanges of the rack loader and permit temporary storage and movement of the shield plug and of canisters of transuranic material.

7 Claims, 2 Drawing Sheets

RACK LOADER AND METHOD FOR TRANSURANIC TRANSFERS INTO AND OUT OF STORAGE

This invention relates generally to the storage and transfer of hazardous materials, and specifically to a loader and method for safe and secure radioactive transuranic material transfers into and out of storage.

One well known challenge in working with radioactive materials is the acute need to move and store such materials in a safe, secure manner. In particular, highly radioactive and fissionable transuranic materials pose an extreme environmental risk and call for special systems for storage, transfer and inspection.

Numerous schemes have been devised for the transfer of highly radioactive fuel. Various types of shielded transfer casks, for example, have been applied to the particularly difficult problem of unloading and transferring spent fuel from shipboard reactors into transportation casks. However, no such system has been known to be applied to the unique problems of combinations of high specific activity transuranic materials and fissionable transuranic materials such as combinations of americium and plutonium.

When transferring highly radioactive materials within a storage area, there are generally two alternative approaches that are used to minimize radiation exposure of personnel. The first is through increasing the distance of the personnel from the source of the radiation, e.g., through use of remotely operated equipment. This equipment may include robots, manually operated long handled tools, remotely operated cranes, stackers, and retrievers. The second approach is through application of local shielding such as lead "pigs" or shielded transfer casks.

Transuranic materials can emit both neutron and gamma radiation, and can be extremely hazardous to personnel because of long half-lives and extended retention by specific body organs. The uptake of a single small particle of such material can result in chronic exposure that perpetually exceeds occupational dose limits. In known transfer and storage schemes, uptake of airborne radioactive particles is reduced through either "confinement" or "containment." Confinement involves ventilation systems having specialized filtering subsystems that capture any free radioactive particles. These systems are limited in that they cannot ensure against uptake resulting from accidental releases in the storage environment. Containment involves positive control of all material near the source of radioactivity to ensure that no contaminated material has the opportunity to enter the environment in which the personnel are operating.

A major consideration in the transfer and storage of fissionable transuranic materials is security from theft. To safeguard such materials from theft typically requires material validation and periodic inspection of containers. During transfer operations, numerous security personnel typically are required to verify the integrity of each operational step. Not only is this requirement costly, it poses the potential of significant radiation exposure for a significant number of personnel.

Still another consideration in storing all transuranic materials is the ability to make inspections of the material and its containers. Specifically, safety concerns mandate that containers be inspected periodically to verify that their boundaries have not been breached, and that the transuranic material be available for inspection to verify that it is not becoming unstable during long-term storage.

The transfer and storage of highly active transuranic materials thus requires that a number of diverse considerations be addressed: protection to operating personnel during loading and unloading operations, protection to the public at all times, long-term safety evaluation, elimination of serious exposure hazards resulting from uptake and equipment contamination, inventory confirmation, theft prevention, and positive controls over placement and retrieval.

None of the known schemes for loading, transferring, or storing radioactive materials is known to meet all of the above requirements in applications involving transuranic materials. Therefore, a need remains for a system and method for transferring transuranic materials into and out of storage and periodically monitoring the condition of such material in a manner that meets all of the requirements stated above.

SUMMARY OF THE INVENTION

In accordance with the present invention, a system for storing and transferring radioactive material includes a storage tube with an open end, a shield plug for the open end of the tube, a hoist for removing the shield plug from the open end of the tube, and a shielding structure around the hoist.

In another aspect of the invention, a shield plug cart attaches to the shielding structure and stores the shield plug when it is removed from the storage tube.

In still another aspect of the invention, a material transfer cart attaches to the shielding structure, and canisters of radioactive material are moved between the storage tube and the material transfer cart.

In yet another aspect of the invention, a seal is used so that the storage tube and the shielding structure form a leakproof cavity.

In still another aspect of the invention, a vacuum device removes potentially contaminated particles from the cavity.

In yet another aspect of the invention, a shield plug conveyance moves the shield plug between the shielding structure and the shield plug cart.

Also in accordance with the present invention, a method of storing radioactive material includes surrounding an end of a storage tube with a shielding structure; attaching a shield plug cart to the shielding structure; attaching a material transfer cart to the shielding structure; transferring the radioactive material from the material transfer cart to the shielding structure; transferring the radioactive material from the shielding structure to the storage tube; transferring a shield plug from the shield plug cart to the shielding structure; and placing the shield plug in the end of the storage tube.

Still further in accordance with the invention, a method of verifying the contents of a container for radioactive material includes transferring the container from a storage location to a cart and determining, while the container is located on the cart, selected characteristics of the container.

The features and advantages described in the specification are not all-inclusive, and particularly, many additional features and advantages will be apparent to one of ordinary skill in the art in view of the drawings, specification, and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

DETAILED DESCRIPTION OF THE DRAWINGS

The figures depict a preferred embodiment of the present invention for purposes of illustration only. One skilled in the art will readily recognize from the following discussion that alternative embodiments of the structures and methods illustrated herein may be employed without departing from the principles of the invention described herein.

Figure 1:
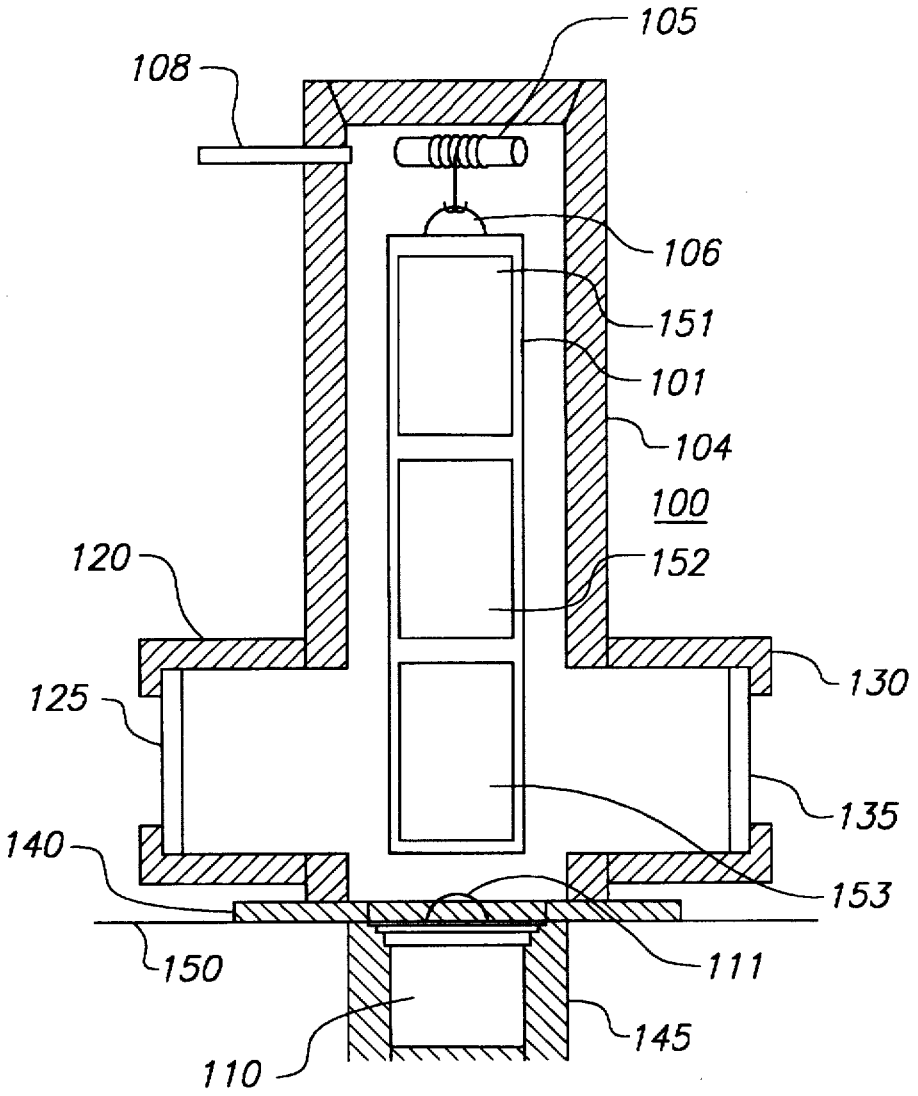
FIG. 1 illustrates a shielded rack loader (100), in accordance with the present invention.

Referring now to FIG. 1, there is shown a shielded rack loader 100 for the storage and transfer of transuranic material. As illustrated in FIG. 1, shielded rack loader is formed primarily of a shielding structure 104 surrounding a loading rack 101. Since transuranic materials can emit both neutron and gamma radiation, shielding from both such types of radiation is important for the safety of personnel. In practice, it is found that constructing shielding structure 104 from lead, with an inner lining of high density polyethylene, and with a structural can of stainless steel as an outer lining, provides shielding structure 104 with good radiation shielding characteristics as well as durability. The polyethylene shields against neutron radiation, while the lead shields against gamma radiation. In other embodiments of the invention, other heavy metals such as uranium or tungsten may be used rather than lead for shielding against gamma radiation in shielding structure 104. The stainless steel structurally retains and positions the shielding structure 104 of rack loader 100, ensures integrity with floor seal 140 and flanges 120, 130, and provides support for the lifting winch and grapple assembly 105. The stainless steel can construction of rack loader 100 provides sufficient durability to allow for handling of the rack loader 100 by use of cranes and other heavy equipment. In some applications, a single rack loader 100 may be positioned as desired over a number of storage tubes, e.g., 145, in a facility as required for periodic testing and inspection of the material stored in such tubes.

In operation, plutonium is stored in conventional double or triple containment canisters or "containers" 151–153 kept in a conventional storage tube 145 disposed beneath floor 150. A conventional leak tight, inflatable floor seal 140 is disposed between storage tube 145 and rack loader 100 to prevent the leakage of contaminated particles to the outside environment. A removable shield plug 110 is used to close the opening of storage tube 145 when the containers are in place in storage tube 145.

It should be noted that for clarity, FIG. 1 shows shield plug 110 in place and shows containers 151–153 hoisted out of storage tube 145. As is evident from the description herein, these components are not, in normal operation, simultaneously disposed in the positions shown in FIG. 1.

For storage purposes, containers 151–153 are lowered into storage tube 145 after shield plug 110 has been removed from the location shown in FIG. 1. A conventional winch/grapple connector assembly 105 is used, along with hoisting connector 106, to lower loading rack 101 with containers 151–153 into storage tube 145. Once the containers have been lowered, winch/grapple assembly 105 is disconnected from hoisting connector 106. Then, shield plug 110 is inserted into rack loader 100 through door 125 as is described in greater detail in connection with FIG. 2, winch/grapple connector assembly 105 is connected to hoisting connector 111 of shield plug 110, and shield plug 110 is lowered to the position shown in FIG. 1 to seal off the top of storage tube 145.

It should be recognized that any conventional hoisting apparatus remotely operable from outside of shielding structure 104 may be used to implement winch/grapple connector assembly 105. For example, a grappling device connected to an electric winch, or to a manual winch with a crank handle extending through shielding structure 104, could be used. Some applications might permit use of an electromagnet or other devices as a grapple. Preferably, the hoisting apparatus for any particular application allows confirmation that the winch/grapple connector assembly 105 has been coupled to the loading rack 101 or shield plug 110, e.g., by engagement of a grappling connector with a hoisting connector 106, 111; permits simple and confirmable decoupling of the winch/grapple connector assembly 105 from the loading rack 101 or shield plug 110, as appropriate, when proper positioning of the same has been attained, and is remotely controllable from outside of shielding structure 104.

Although the embodiment illustrated in FIG. 1 shows three containers 151–153, it should be apparent that other numbers of containers could also be used.

A vacuum pipe 108 extends through shielding structure 104 and is connected to a ventilation system (not shown). The ventilation system provides a negative pressure (vacuum) that prevents air laden with potentially contaminated particles from escaping through doors 125, 135, floor seal 140, or elsewhere. The contaminated particles are trapped by the ventilation system, which is fitted with conventional means for collecting and storing contaminated airborne particles.

Thus, as FIG. 1 illustrates, the elements of rack loader 100 are self-contained in a single unit so that these potentially contaminated elements easily may be checked to verify that they are not, in fact, contaminated.

Figure 2:
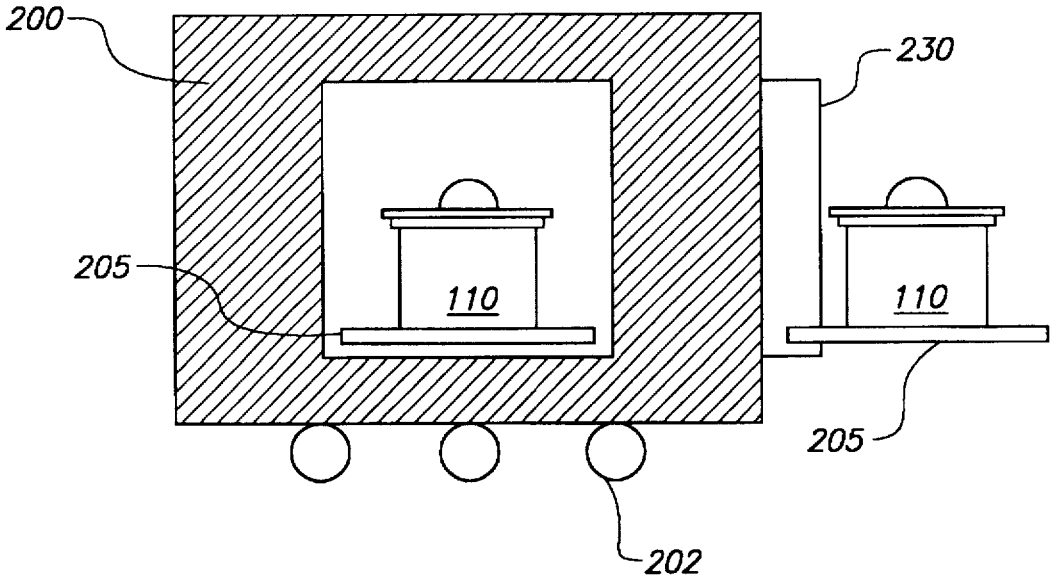
FIG. 2 illustrates a shield plug cart (200), in accordance with the present invention.
Figure 3:
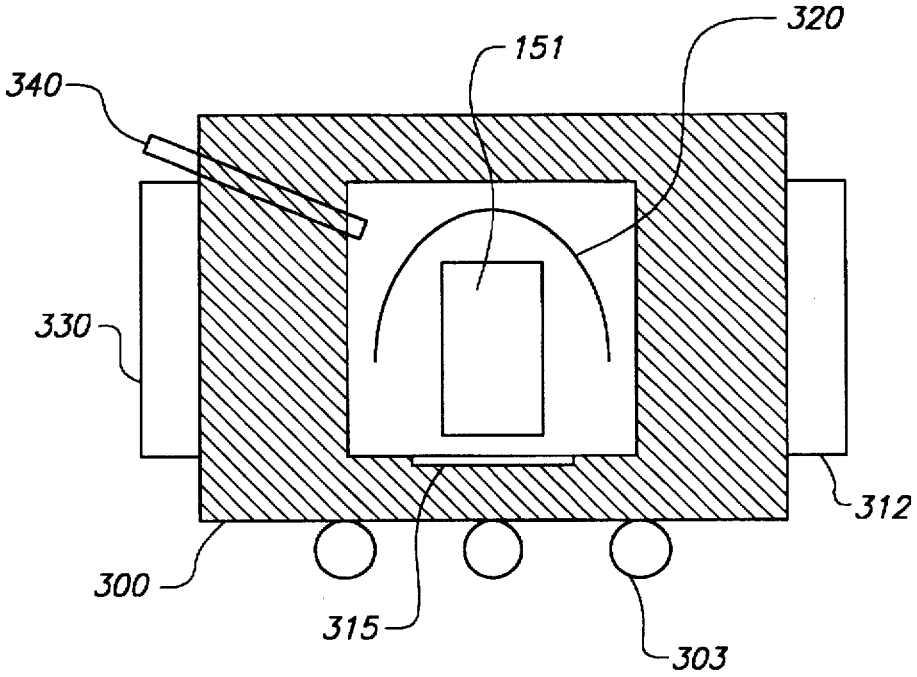
FIG. 3 illustrates a material transfer cart (300), in accordance with the present invention.

Referring now also to FIGS. 2 and 3, movement of containers, e.g., 151 is achieved using a shield plug cart 200 and a material transfer cart 300. Specifically, shield plug cart 200 is movable on conventional wheels 202 so that shield plug cart 200 may be placed such that rack loader interlock 230 engages with receiving flange 120 of rack loader 100. Receiving flange 120 and door 125 are adapted, in a conventional manner, to form a sealed, leak-free passageway between rack loader 100 and shield plug cart 200 when engaged with rack loader interlock 230. Once so engaged, winch/grapple connector assembly 105 is operated so that hoisting connector 111 is grappled, and winch/grapple connector assembly 105 is again operated so that shield plug 110 is lifted from its resting spot in floor 150. An extendible tray assembly 205 of shield plug cart 200 is then moved from a retracted position (shown by solid lines in FIG. 2) to an extended position (shown by broken lines in FIG. 2). In the extended position, tray 205 is located directly under hoisted shield plug 105. Winch/grapple assembly 105 is then operated to lower shield plug 110 onto tray 205, and tray 205 is then returned to its retracted position.

In one embodiment, extendible tray 205 is implemented by a conventional dual-suspension drawer-type slide mechanism, for instance as used in filing cabinets. In another embodiment, a rack and pinion support and extension mechanism is used. It should be recognized that any conventional manner of implementing extendible tray 205 can be used. Preferably, movement of extendible tray 205 is achieved through use of a geared or direct drive conveyor system, powered either by a hand crank extending to the outside of shield plug cart 200, or by an electric motor remotely operable from the outside of shield plug cart 200.

Rack loader interlock 230 further includes a conventional leak-proof sealing door similar to door 125 that is only capable of being opened when cart 200 is fully mated to receiving flange 120. In this manner, cart 200 is fully closed and locked when not coupled to receiving flange 120.

For safety reasons, it is also preferable that electric or other conventional interlock systems be incorporated in rack loader 100, shield plug cart 200, and material transfer cart 300 so that mechanisms for grappling, moving, and otherwise manipulating potentially contaminated material are disabled under any unsafe condition. For example, winch/grapple connector assembly 105 should be configured so as not to disengage from shield plug 110 unless it is either at the height of tray 205 and tray 205 is extended, or shield plug 110 is in its resting position in floor 150 as shown in FIG. 1. Similarly, it is preferable to prevent winch/grapple 105 from hoisting shield plug 110 unless engagement of shield plug cart 200 with receiving flange 120 is confirmed.

Once shield plug 110 has been moved to shield plug cart 200, access to containers 151–153 is possible. Material transfer cart 300 includes a rack loader interlock 330 that engages with receiving flange 130 and door 135 to form a sealed, leak-free passageway from rack loader 100 to material transfer cart 300. The configuration of flange 130, door 135 and interlock 330 may be either the same as the corresponding components 120, 125 and 230, or they may be made intentionally different and incompatible if varying levels of security are desired in a particular implementation for access to a shield plug and access to a container, e.g., 151.

Security from theft is a major consideration in the storage of plutonium and other transuranic materials, and material transfer cart 300 includes a number of features to provide for verification and monitoring using technical security controls that are not as dependent on human guards as is previous apparatus. In a preferred embodiment, the conventional two-man rule is adhered to, where two people are required to operate material transfer cart 300 so as to gain physical access to the transuranic material. Conventional card key operated locks are operated by each person in order to transfer material from the storage tube 145, into the shielded rack loader 100, and then into the material transfer cart 300. Configuring cart 300 to be operated by two people guards against override of the technical security features of cart 300. Depending on the particular application, some or all of these security features, or other conventional security features, may be implemented for shield plug cart 200 as well.

In a preferred embodiment, both carts 200 and 300 include conventional coded key card access control for each of two human operators. This access control is responsible for providing security for operations such as unlocking the shield plug 110 and moving it to its "parked" position in the shield plug cart 200, raising loading rack 101 from a storage position in storage tube 145 to a designated loading position such as is illustrated in FIG. 1 so that only an authorized plutonium container, e.g., 152 is available for transfer. The position of loading rack 101 is controlled by limit switches (not shown) or by other conventional means.

In a preferred embodiment, access control requires material transfer cart 300 to be mated to receiving flange 130 before any movement of loading rack 101 is possible. In a preferred embodiment, rack loader interlock 330, as well as interlock 230, include electronic circuitry connections to implement the access controls described above. Rack loader interlock 330 further includes a conventional leak-proof sealing door similar to door 135 that is only capable of being opened when cart 300 is fully mated to receiving flange 130. In this manner, cart 300 is fully shielded and locked when not coupled to receiving flange 130.

When cart 300 is coupled to receiving flange 130, a container, e.g., 153, of transuranic material at the level of door 135 is transferred between loading rack 100 and cart 300 by conventional means (not shown). In one embodiment, tray conveyor/roller means are used; in another, a fork-lift type conveyance is employed, operable in the same manner as described with respect to extendible tray 205 of shield plug cart 200. It should be recognized that other conventional conveyance apparatus could also be used. Preferably, conventional optical or electronic devices are used to indicate which levels of loading rack 100 have containers, e.g., 151–153, present in them.

Cart 300 is further provided with conventional wheels 302 to allow movement of cart 300 from one location to another. In a preferred embodiment, cart 300 is pushed by operating personnel, but in alternate embodiments a powered drive train mechanism is used to propel cart 300.

Once a container, e.g., 151, is loaded onto cart 300, the container can be inspected in several ways. An electronic scale 315 provides an indication of the weight of the container 151 to verify that the container has not leaked, thereby permitting oxidation and weight gain.

A leak detection port 340 is constructed of stainless steel tubing with a conventional fitting. Through this port 340, Helium or other inert gas is provided at a strong positive pressure into cart 300 for a period of time. The same port is then used to purge and evacuate the inert gas from cart 300. Then, by conventional helium sniffing, a determination is made as to whether any of the gas penetrated container 151, thereby indicating that the container is flawed.

A radiation detector array 320 connected to conventional gamma ray spectroscopy apparatus (not shown) is used to analyze the radiation signature of the material inside container 151 to verify that the material has not been stolen and replaced with other material of a similar weight. Conventional x-ray and film ports (not shown) are also provided in cart 300 to allow visual and x-ray analyses of container 151.

Cart 300 also includes a glove box interlock 312. In operation, cart 300 may be moved to a conventional glove box inspection facility (not shown) that includes a flange and door for mating with glove box interlock 312. In this manner, containers may be transferred in to, or out of, a conventional glove box for whatever purpose may be desired.

From the above description, it will be apparent that the invention disclosed herein provides a novel and advantageous method and system providing storage and transfer of high-activity transuranic materials. The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

What is claimed is:

1. A system for storing canisters of radioactive material, comprising:

a storage tube disposed to accept such canisters, said storage tube having an open end;

a shield plug removably disposed in said open end;

a hoist conveyance adapted to remove said shield plug from said open end and to remove said canisters from said storage tube; and a shielding structure substantially surrounding said hoist conveyance and adapted to accept said shield plug upon removal of said shield plug from said open end, and to accept said canisters upon removal of said canisters from said storage tube.

2. A system as in claim 1, further comprising a shield plug cart coupled to said shielding structure and adapted to accept said shield plug upon removal of said shield plug from said open end.

3. A system as in claim 1, further comprising a material transfer cart coupled to said shielding structure and adapted to accept said one of said canisters upon removal of said one canister from said open end.

4. A system as in claim 1, wherein said system further comprises a leakproof seal disposed between said shielding structure and said open end, said storage tube, leakproof seal and shielding structure forming a leakproof cavity.

5. A system as in claim 4, further comprising a vacuum assembly operable coupled with said leakproof cavity and adapted to remove contaminated particles from said leakproof cavity, to monitor said contaminated particles, and to prevent said contaminated particles from escaping from said system.

6. A system as in claim 2, wherein said shield plug cart further comprises a shield plug conveyance assembly for moving said shield plug between said shielding structure and said shield plug cart.

7. A system as in claim 3, wherein said material transfer cart further comprises examination facilities adapted to permit verification of the contents of said one canister.

* * * * *